US007019446B2

(12) United States Patent
Funsten et al.

(10) Patent No.: US 7,019,446 B2
(45) Date of Patent: Mar. 28, 2006

(54) FOIL ELECTRON MULTIPLIER

(75) Inventors: Herbert O. Funsten, Los Alamos, NM (US); Juan R. Baldonado, Los Alamos, NM (US); Eric E. Dors, Los Alamos, NM (US); Ronnie W. Harper, Los Alamos, NM (US); Ruth M. Skoug, Los Alamos, NM (US)

(73) Assignee: The Regents of the University of California, Los Alamos, NM (US)

( * ) Notice: Subject to any disclaimer, the term of this patent is extended or adjusted under 35 U.S.C. 154(b) by 15 days.

(21) Appl. No.: 10/671,109

(22) Filed: Sep. 25, 2003

(65) Prior Publication Data

US 2005/0067932 A1 Mar. 31, 2005

(51) Int. Cl.
*H01J 43/00* (2006.01)

(52) U.S. Cl. ..... 313/103 R

(58) Field of Classification Search ..... 313/523, 313/528, 532–536, 538, 542, 103 R, 103 CM, 313/105 CM; 250/214 VT
See application file for complete search history.

(56) References Cited

U.S. PATENT DOCUMENTS 4,073,989 A 2/1978 Wainer ..... 428/131
4,095,132 A 6/1978 Fraioli ..... 313/103
4,668,890 A 5/1987 Swingier ..... 313/105
5,086,248 A 2/1992 Horton et al. ..... 313/103
5,338,927 A * 8/1994 de Groot et al. ..... 250/214 VT
5,680,008 A 10/1997 Brandes et al. ..... 313/533
6,015,588 A 1/2000 Goukassian ..... 427/77
6,045,677 A 4/2000 Beetz, Jr. et al. ..... 205/50
6,455,987 B1 9/2002 Durst et al. ..... 313/103

* cited by examiner

*Primary Examiner*—Vip Patel
(74) *Attorney, Agent, or Firm*—Mark N. Fitzgerald

(57) ABSTRACT

An apparatus for electron multiplication by transmission that is designed with at least one foil having a front side for receiving incident particles and a back side for transmitting secondary electrons that are produced from the incident particles transiting through the foil. The foil thickness enables the incident particles to travel through the foil and continue on to an anode or to a next foil in series with the first foil. The foil, or foils, and anode are contained within a supporting structure that is attached within an evacuated enclosure. An electrical power supply is connected to the foil, or foils, and the anode to provide an electrical field gradient effective to accelerate negatively charged incident particles and the generated secondary electrons through the foil, or foils, to the anode for collection.

20 Claims, 7 Drawing Sheets

FOIL ELECTRON MULTIPLIER

STATEMENT REGARDING FEDERAL RIGHTS

This invention was made with government support under Contract No. W-7405-ENG-36 awarded by the U.S. Department of Energy. The government has certain rights in the invention.

FIELD OF THE INVENTION

The present invention relates generally to electron multipliers and, more particularly, to electron multipliers used in photomultipliers and particle detectors such as channel electron multipliers and microchannel plates that are used extensively in electron spectrometers, mass spectrometers, and photonic detectors.

BACKGROUND OF THE INVENTION

Two types of conventional electron multipliers are routinely used. A first type, pictorially illustrated in FIG. 1, consists of discrete dynode multipliers, which comprise dynodes stages 10 that initiate and amplify a cascade of electrons. U.S. Pat. No. 4,668,890, issued May 26, 1987, details this type of electron multiplier. Typically, dynode stages 10 are biased using resistor divider string 20 such that front dynode 12 of the multiplier is biased to a high negative voltage (e.g., several kilovolts) relative to last dynode 14 and anode 16 of the multiplier. Thus, an electric field is imposed between each of the dynodes. As incoming particle 30 strikes the front dynode 12 it generates an average of $\gamma_I$ secondary electrons 32 from the impact surface of front dynode 12. These secondary electrons are accelerated by the imposed electric field toward the next successive dynode, where they impact and generate more secondary electrons. This cascade of electrons continues throughout the entire series of dynode stages with the cumulative charge of the electron avalanche growing at each stage. After last dynode 14, the electron avalanche charge is collected on anode 16.

The gain ($G_D$) of a discrete dynode multiplier, which equals the cumulative output electron charge per incident particle, corresponds to:

$$G_D=\gamma_I\gamma_{SE}^{N-1} \quad \text{(Equation 1)}$$

where $\gamma_{SE}$ equals average number of secondary electrons emitted by an electron from one dynode impacting on the next sequential dynode and N equals the number of dynodes used in the detector. To maximize the gain, the dynode material is often selected for high secondary electron emission yield ($\gamma_{SE}$) properties (See U.S. Pat. No. 5,680,008, issued Oct. 21, 1997).

The second type of multiplier is a continuous electron multiplier, pictorially illustrated in FIG. 2. Channel electron multipliers and microchannel plate (MPC) detectors are specific examples of this type. MPCs employ one or more high resistivity glass channels or tubes 40, each of which acts as a series of continuous dynodes. Patented examples of this type of electron multiplier include: U.S. Pat. No. 4,095,132, issued Jun. 13, 1978; U.S. Pat. No. 4,073,989, issued Feb. 14, 1978; U.S. Pat. No. 5,086,248, issued Feb. 4, 1992; U.S. Pat. No. 6,015,588, issued Jan. 18, 2000; and U.S. Pat. No. 6,045,677, issued Apr. 4, 2000.

As with the discrete dynode, channel front 42 is negatively biased several kilovolts relative to the channel back 44 and anode 50, so that an electric field is imposed inside of the channel from the front (entrance) to the rear (exit). Incident particle 60 impacts channel front 42 and generates secondary electrons 62, which are then accelerated further into tube 40 by the imposed electric field. Secondary electrons 62 impact channel wall 41 and generate even more secondary electrons. The cumulative charge of the electron avalanche grows as it traverses tube 40. The avalanche of secondary electrons 62 exits tube 40, and is collected on anode 70. The gain of a continuous electron multiplier can be modeled as a series of discrete dynodes and can therefore be represented by Equation 1. A variation of this concept uses a porous media having irregular channels; e.g., U.S. Pat. No. 6,455,987, issued Sep. 24, 2002.

A foil electron multiplier, in accordance with the present invention, encompasses the next generation design of electron multipliers. In a preferred embodiment, a series of extremely thin, in-line foils are used to create secondary electrons. The in-line orientation of the foils coupled with their thinness not only creates secondary electrons, but allows the incident primary particles, and the secondary electrons generated by the primary particles, to continue to the next and subsequent foils. It is believed that this design not only creates a larger avalanche of electrons when compared to historical designs, but also allows for obtaining position-sensitive information on where an incident particle impacted the first stage of the foil electron multiplier. The ability to provide position-sensitive information enables improvements on articles such as flat television screens, computer screens, night vision devices, and the like.

Advantages of the foil electron multiplier design over other types of electron multipliers include:

(1) A higher gain per multiplication stage that results in an increased multiplication efficiency since fewer stages are required to obtain the same charge as other multipliers.

(2) Simplicity of fabrication, since the foil fabrication process (evaporation of a foil material onto a glass slide covered with a surfactant and a subsequent aqueous transfer to a support grid or aperture plate) is simpler than fabrication of continuous multipliers, such as MCPs. The MCP fabrication process requires high purity materials, high precision, a high level of cleanliness, and involves using cladded fibers that must be bundled, stretched, and sintered in cycles, and then cut, etched, and chemically activated.

(3) A lower cost of fabrication, as the fabrication process complexity is reflected in the relevant cost. Twenty commercial foils cost about $500 whereas MCP detectors cost about $5,000 to $10,000.

(4) An ability to cover a larger area, as foils can be evaporated over large surface areas, whereas MCPs require additional bundling and sintering to increase the surface area. Also, large area foils are much more robust as they can be dropped without breaking, whereas MCPs shatter.

(5) Finally, the foil electron multiplier exhibits an intrinsic rejection of ion feedback at each stage. Continuous electron multipliers require a curved or zigzag path to prevent ions from being accelerated back toward the entrance where they can initiate a second pulse. In the foil electron multiplier, ions generated at one foil may be accelerated back to the previous foil, but cannot be re-transmitted back because the ion energy is too low. Therefore, ions can only reach one stage back, and a pulse that they generate will be indistinguishable from the main pulse.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

In accordance with the purposes of the present invention, as embodied and broadly described herein, the present invention includes an apparatus for electron multiplication by transmission that is designed with at least one foil having a front side for receiving incident particles and a back side for transmitting secondary electrons that are produced from the incident particles transiting through the foil. The foil thickness enables the incident particles to travel through the foil and continue on to an anode or to a next foil in series with the first. The foil, or foils, and anode are contained within a supporting structure that is attached within an evacuated enclosure. An electrical power supply is connected to the foil, or foils, and the anode to provide an electrical field gradient effective to accelerate negatively charged incident particles and the generated secondary electrons through the foil, or foils, to the anode for collection.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

A foil electron multiplier, in accordance with the present invention, uses a sequential series of thin foils in an evacuated enclosure that act to multiply electrons in a series of transmission stages. A voltage is applied to each foil to accelerate electrons emitted from the back of one foil to an energy level that effectively transmits the electrons through the next foil in the series, as well as generating secondary electrons that add on to the transmitted electrons and continue on to the next foil in the series. Thus, the present invention may be used for amplification of an incident electron flux or for detection of particles (e.g., photons, ions, electrons, and the like). Therefore, the present invention may be used in photomultiplier tubes and particle detectors, such as channel electron multipliers and microchannel plates. Channel electron multipliers and microchannel plates are used extensively in electron spectrometers, mass spectrometers, and photonic detectors, such as night vision devices.

Figure 1:
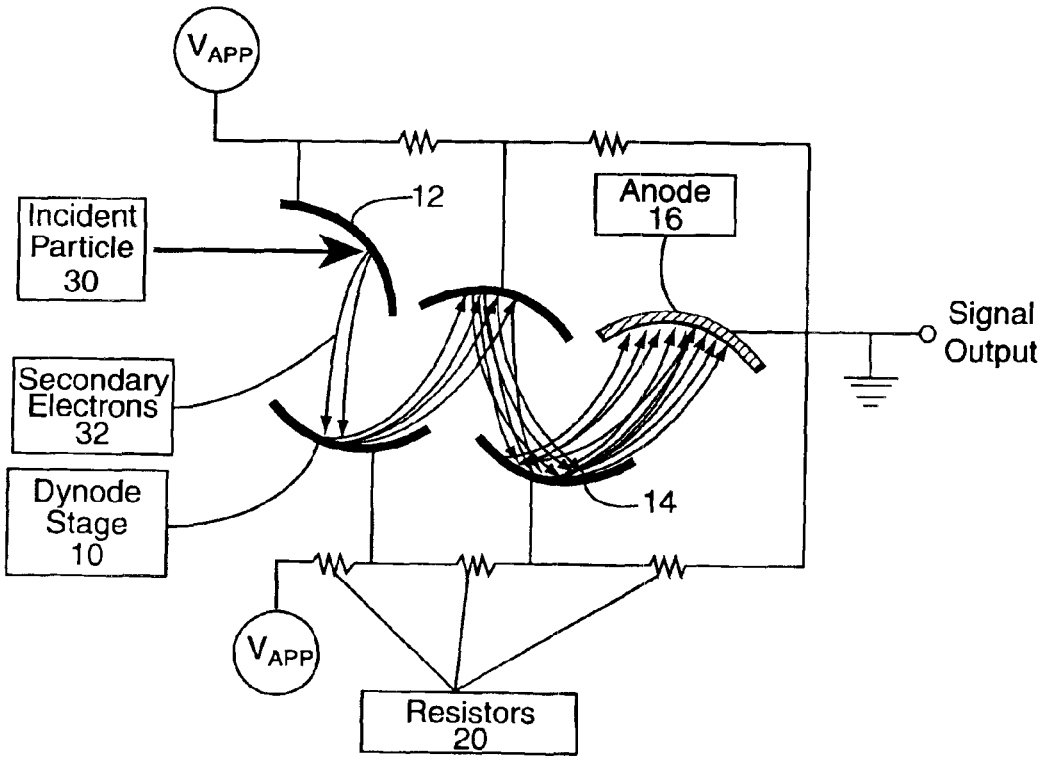
FIG. 1 (Prior Art)
FIG. 1 is a pictorial illustration of a prior art discrete dynode electron multiplier
Figure 2:
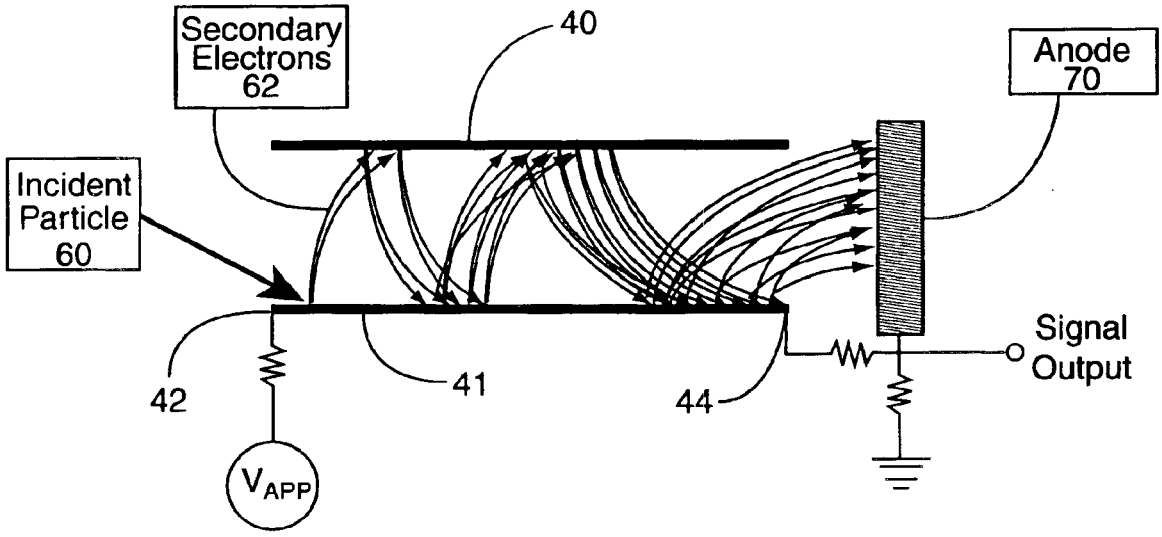
FIG. 2 (Prior Art)
FIG. 2 is a pictorial illustration of a prior art continuous dynode electron multiplier
Figure 3A:
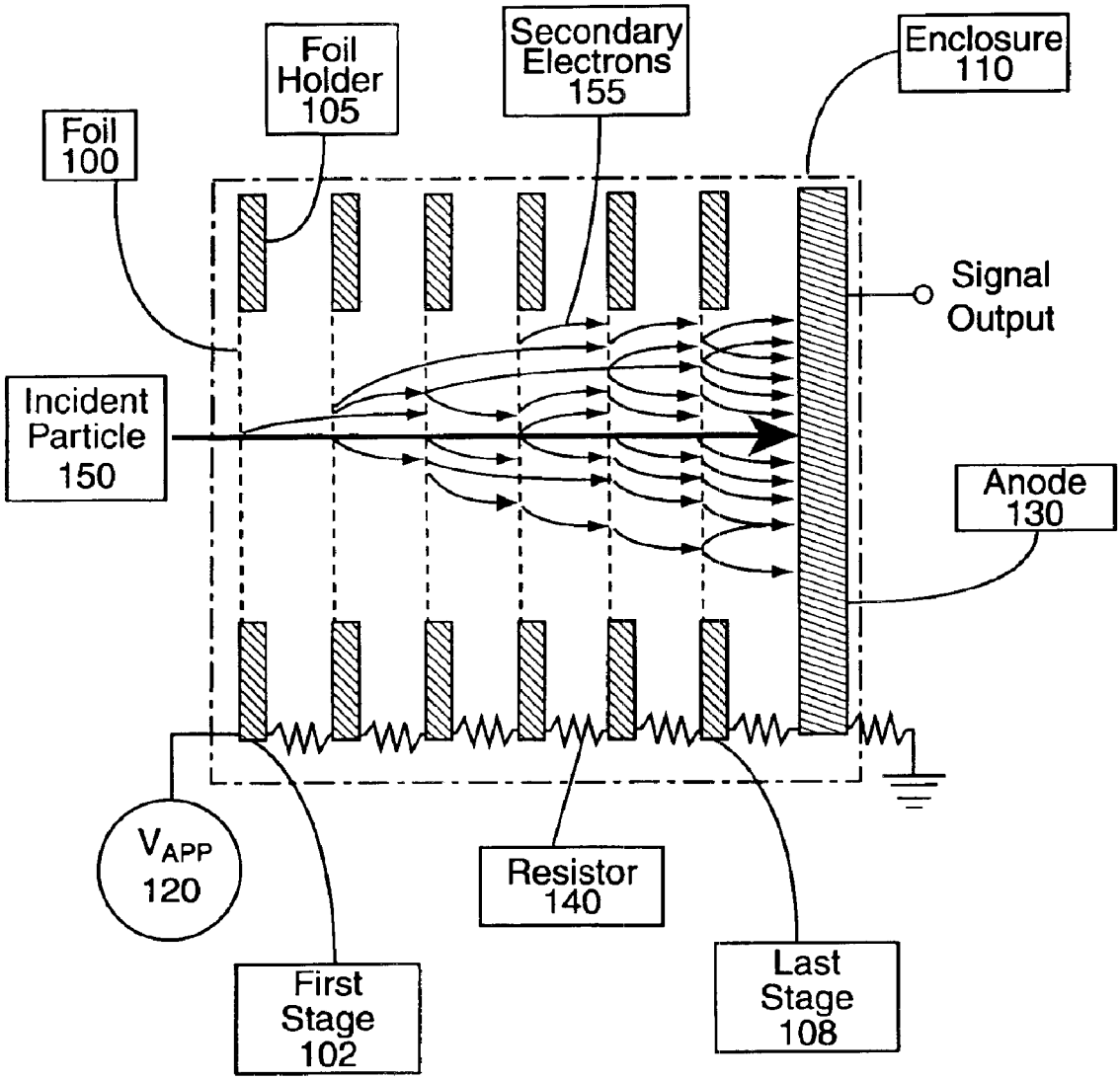
FIGS. 3*a* and 3*b* are pictorial illustrations of embodiments of the present invention foil electron multiplier.
Figure 3B:
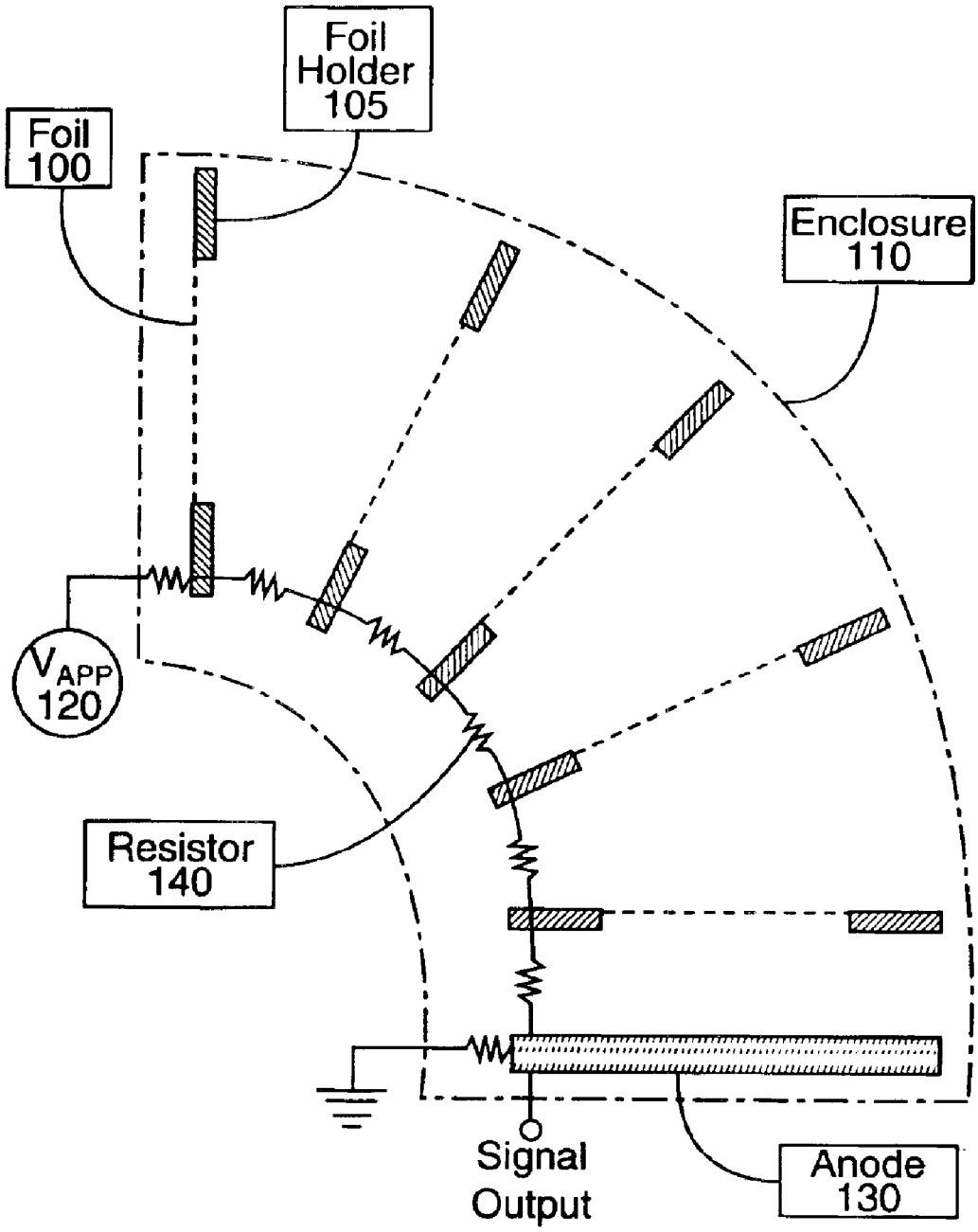

Referring to FIGS. 3*a* and 3*b*, the foil electron multiplier comprises a series of thin foils 100 held by foil holders 105 in an evacuated enclosure 110 that form discrete multiplication stages. In a preferred embodiment, foils 100 are arranged collinearly, although it will be understood that foils 100 can be arranged in an array that is along an arc as shown in FIG. 3*b*. Voltage 120 is applied to each foil 100, so that secondary electrons 155 created by incident particle 150 are accelerated in a direction from first stage 102 of the multiplier through last stage 108 and collected onto anode 130. The voltage on each stage can be applied, for example, by attaching electrical resistors 140 between adjacent stages to form a resistor divider string across the multiplier, or by attaching separate power supplies (not shown) to each stage. This results in an electric field having a positive gradient between adjacent foils that accelerates secondary electrons between successive stages in the multiplier.

If the foil electron multiplier is used in photomultiplier device, the anode could, for example, be a made from a scintillator material that converts electron energy to light. When using the foil electron multiplier as a detector, the anode is electrically connected to sensing electronics that measure the output charge or current deposited onto the anode. For example, a pulse of electrons resulting from a single particle that is incident on the foil multiplier can be directed into an electronic amplifier, whereupon the amplified pulse can be measured using detection electronics. As another example, an ammeter can measure the amplified current of a particle flux incident on the foil electron multiplier. Since the foil electron multiplier can span a large active area, a position-sensitive anode could provide position-sensitive information on where an incident particle impacted a stage of the foil electron multiplier.

Foil electron multipliers, as shown in FIGS. 3*a* and 3*b*, are defined as having N foils and a resistor divider between each foil with an applied voltage $V_{APP}$, for N>1, such that the potential between individual stages is $V_S=V_{APP}/(N-1)$. An incident particle (electron, ion, or photon) transits through the first foil and generates an average of $\gamma_I$ secondary electrons at the rear surface. The secondary electrons are then accelerated by the voltage $V_S$ between the first and second stages toward the second foil and are transmitted with a probability $T_{SE}$ through the second foil, where $T_{SE}$ depends on the foil thickness $\tau$ and accelerating potential $V_S$. If an electron from the first stage successfully transits through the second foil and exits at an energy E, it will generate a second set of electrons at an average secondary electron emission yield equal to $\gamma_{SE}$, where $\gamma_{SE}$ is a function of E, and, therefore, a function of foil thickness $\tau$ and accelerating potential $V_S$. This electron multiplication process continues at each foil stage, resulting in a growing avalanche of electrons, which are finally deposited onto the anode.

The mean gain, $G_N$, of the foil electron multiplier with N stages resulting from impact of a particle with the first stage is:

$$G_N=T_I T_G \gamma_I [T_{SE} T_G [\gamma_{SE}+1]]^{N-1} \quad \text{(Equation 2)}$$

where $T_I$ is the probability of incident particle transmission through the first foil. Often, the foil can be thin enough to require a supporting grid for structural integrity, and $T_G$ equals the transmission through such a grid of a single stage. The term $T_I T_G \gamma_I$ corresponds to the mean number of secondary electrons generated at the first stage by the incident particle. The term $T_{SE} T_G$ corresponds to the probability that a secondary electron successfully transits the second or subsequent stage, and the term $(\gamma_{SE}+1)$ corresponds to the mean number of secondary electrons exiting the second or subsequent stage.

Generally, the gain of a foil electron multiplier is maximized by:

1) maximizing the electron transmission $T_{SE}$ of electrons through the foil by operating at an applied bias $V_S$ such that the imposed electric field accelerates electrons to an energy level sufficient to allow the electrons to transit through the foil;

2) maximizing the transmission through the support grid $T_G$ by selecting a grid that provides required structural support but maximizes the grid open area; and 3) maximizing $\gamma_{SE}$ by optimizing the voltage per stage $V_S$ such that electrons transmitted through a foil exit the foil at an optimal energy for high secondary electron emission yield and by selection of a foil material having high secondary electron emission yield.

A preferred embodiment uses as thin of a foil as possible to minimize the required stage bias $V_S$ for electrons to transit a foil. However, a trade-off exists since an extremely thin foil may require a grid for structural support, which results in $T_G<1$ and therefore a reduced gain.

Electrons are negatively charged as they traverse the foil electron multiplier. However, the charge on incident ions may change, because ions can exit a foil with a positive, neutral, or negative charge. If an incident particle exits a stage negatively-charged, the particle is accelerated by the imposed electric field to the next stage similar to an electron. If an incident particle exits a stage positively-charged, the particle will be decelerated by the imposed electric field, and may not transit the foil of the next stage absent sufficient momentum.

For the case of a negatively charged ion, positively charged ion with sufficient momentum, or electron incident on the foil electron multiplier, the ion or electron can transit several or all of the foils, initiating a new electron avalanche at each foil. The pulse of electrons deposited onto the anode therefore consists of all of the avalanches initiated by the ion or electron at each foil. Mathematically, the average total gain for incident particles that can transit all foils in the multiplier ($T_I=1$) and can generate secondary electrons at each stage is represented by:

$$G = \sum_{n=0}^{N-1} T_G^n G_{N-n} \quad \text{(Equation 3)}$$

where $T_G^n$ equals the probability that the incident particle transits all grids before stage N−n. Therefore, Equation 2 can be rewritten as:

$$G = T_G^N T_I \gamma_I \sum_{n=0}^{N-1} (T_{SE}(\gamma_{SE}+1))^n \quad \text{(Equation 4)}$$

Equation 4 represents a series of N terms of increasing magnitude corresponding to additional stages of multiplication, such that each term increases by a factor equal to $T_{SE}(\gamma_{SE}+1)$ relative to its previous term. For the limiting case in which the incident particle impacts only the first stage (n=N−1 only), Equation 4 reduces to Equation 2.

The gain advantage of the foil electron multiplier, which utilizes secondary electrons emitted from the rear surface of a foil, over conventional multipliers, which utilize secondary electrons emitted from the same surface that an incident electron impacts, lies in the term $\gamma_{SE}+1$. First, the secondary electron yield from a primary electron exiting a foil typically should be greater than the secondary electron yield from a primary electron entering a surface, similar to ions transmitted through foils. Therefore, $\gamma_{SE}$ for a foil electron multiplier is likely to be larger than the secondary electron yield for a conventional electron multiplier. Second, a primary electron that generates secondary electrons at the exit surface of a foil stage also continues to the next stage with the secondary electrons that it generated. The continuation of the primary electron with the secondaries that it produces is represented as "+1" in the term $\gamma_{SE}+1$ in Equation 4. This contrasts with conventional electron multipliers in which electrons that impact a dynode are typically absorbed in the dynode material and cannot contribute to further gain in the multiplier.

Ion feedback in electron multipliers, which is important primarily for continuous electron multipliers, results when an ion is created by the electron avalanche and the ion is accelerated in a direction opposite to that of the propagation direction of the electron avalanche due to the imposed electric field. The ion traverses a significant distance of the channel length toward the entrance end of the channel, impacts the channel wall, and initiates another electron avalanche. This results in two avalanches that collectively are observed at the anode as two individual pulses or a single pulse that is temporally long, both of which are generally not desired when the multiplier is used as a particle detector. This limitation can be resolved using curved channels such that an ion generated in a channel cannot travel far within the channel before it impacts the wall of the channel, so that the resulting ion-induced avalanche is nearly indistinguishable in time from the initial electron avalanche.

The present invention does not experience ion feedback. In the electron foil multiplier, ions generated at the input surface of a particular stage are accelerated toward the previous stage, but cannot penetrate the foil. These ions can initiate another avalanche, but this avalanche is generally indistinguishable in time from the initial avalanche.

Foil Electron Multiplier Design

The range of foil dimensions practiced for the present invention is from about 0.5 cm diameter (round) to 2×4 $cm^2$ (rectangular); although this range may be expanded or reduced depending on the application sought. In a preferred embodiment a round 1 cm diameter foil is used. The foil areal thickness can range from about 0.2 $\mu g/cm^2$ to about 2 $\mu g/cm^2$. In a preferred embodiment the range is 0.2 to 1 $\mu g/cm^2$.

Foil dimension and thickness characteristics are directly related to the material selected for foil composition. Using currently available commercial foils, such as those provided by ACF Metals, carbon provides the thinnest and most uniform foils; therefore, carbon is the preferred foil material. However, other materials can also be used, to include: silver, gold, chromium, and hydrocarbons such as Lexan®, and the like.

There is a trade-off between foil thickness and applied voltage: the thinner the foil, the lower the voltage required for the secondary electrons to transit the subsequent foil. In a preferred embodiment, an applied voltage of about −650 V per stage was found to be optimal for a 0.6 $\mu g/cm^2$ carbon foil. A thinner foil would require a lower applied voltage. The distance between foil stages is minimized to save volume, but must be large enough to withstand the applied voltage (i.e. no arcing between adjacent foil stages). A typical, conservative design for high voltage standoff is 1 mm per kV.

Figure 4A:
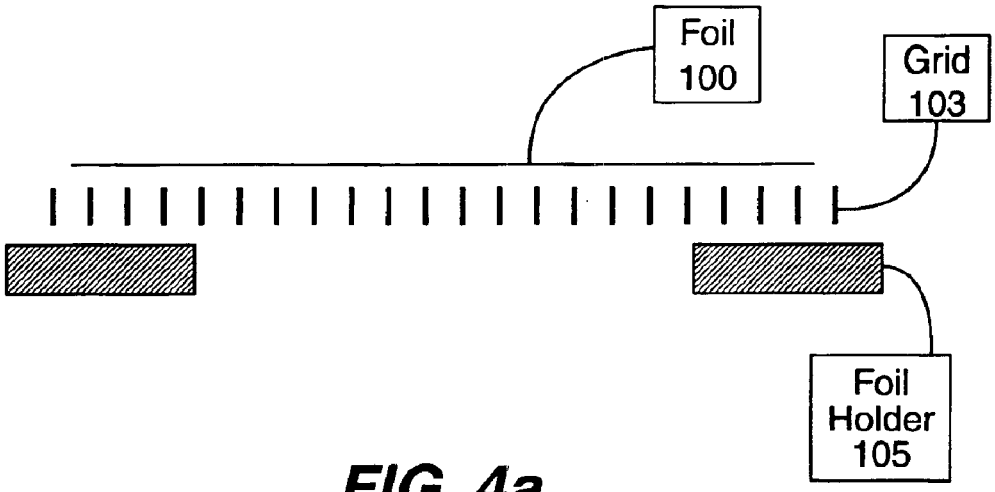
FIGS. 4*a* and 4*b*, a cross-sectional view and face view, respectively, of one embodiment of foil, grid, and foil holder.
Figure 4B:
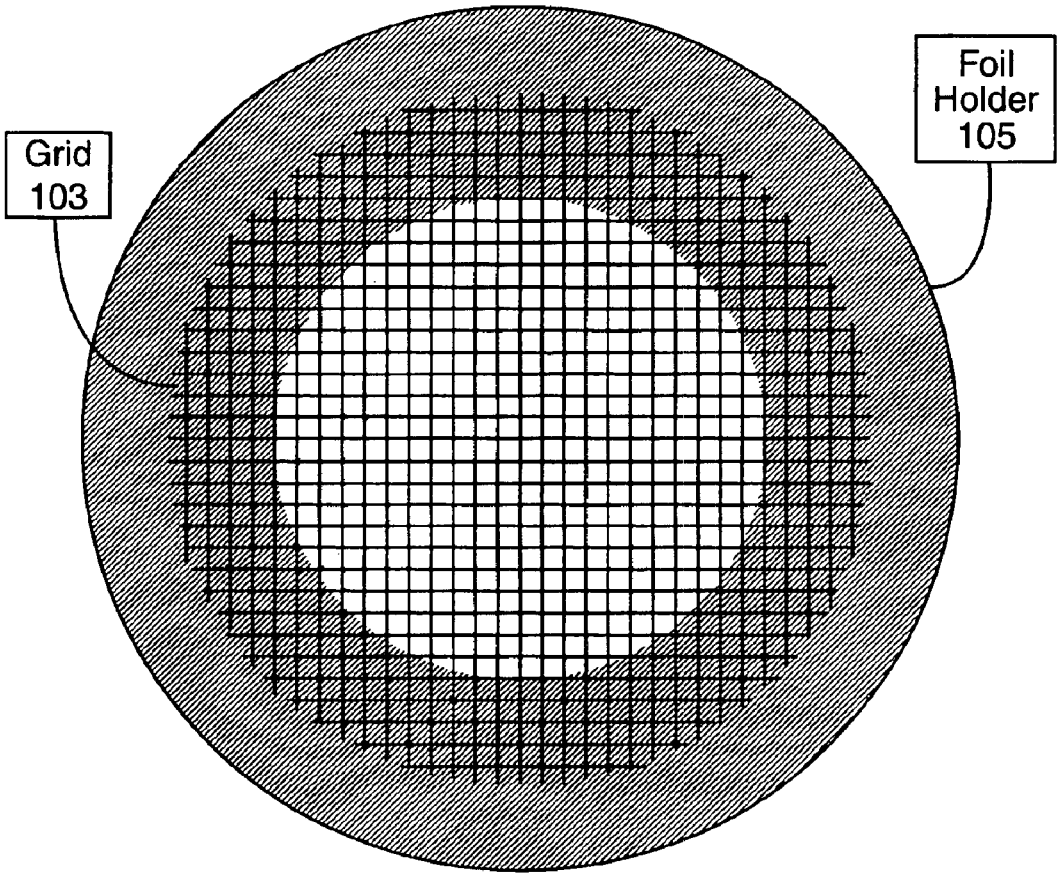

At the preferred foil areal thickness (0.2 to 1 $\mu g/cm^2$) it is not currently possible to span a commercial foil across an aperture without a supporting grid. Thus, a support grid attached to the foil holder and spanning the aperture is required. FIG. 4 displays a preferred embodiment of foil 100, grid 103, and foil holder 105. The foil holder and grid, if required, may be made from any conductive material, such as metals or metal alloys, or semiconductors, or insulators with a finite resistance. Grid 103 may be attached to foil holder 105 by spot welding or may be designed as an integral part of foil holder 105 by using a standard lithography process to etch the grid windows into a sheet of foil holder 105 material. An exemplary embodiment of a support grid is a conductive frame with an attached 200 line-per-inch nickel grid.

For a self-supporting foil, the foil would need to be thicker and, therefore, the applied voltage per stage would need to be higher. However, as commercial fabrication techniques continue to improve, it may be possible to procure very thin, self-supporting foils.

Since a beam of energetic ions transmitted through a thin foil will scatter, and the magnitude of angular scattering increases with increasing foil thickness, measurement of the angular scattering distribution of a narrow beam of ions provides a simple and accurate method to estimate of the foil thickness. The foil electron multiplier was demonstrated using nominal 0.6 $\mu g/cm^2$ areal thickness carbon foils that are typically measured using angular scatter distributions of keV $H^+$ that relate approximately to a 1.5 $\mu g/cm^2$ areal thickness. A foil stage consisted of a conductive frame having a 5-mm-diameter aperture on which was attached a 200 line-per-inch nickel grid, which was used for structural support of the foil and had a transmission of approximately 78%. The commercially available grid was procured from Buckbee-Mears, Inc. A nominal 0.6 $\mu g/cm^2$ areal thickness carbon foil was affixed to the grid.

As shown in FIG. 3*a*, the foil electron multiplier was constructed using a series of foil stages 100 followed by conductive anode 130. Foil stages 100 were aligned in evacuated chamber 110 such that their apertures were collinear. Foil stages 100 were separated by a dielectric material (not shown) such that the spacing between adjacent foil stages was 5-mm. Anode 130, which consisted of a conductive aluminum plate behind last stage 108, collected electrons transmitted through and generated at last stage 108.

Resistors 140 having a resistivity value of 450 MΩ were attached between adjacent foil stages and between last stage 108 and anode 130. Note that the value of resistor 140 between last stage 108 and anode 130 can be much lower without change in detector performance, because the imposed electric field between last stage 108 and anode 130 is only used to direct the electrons from the exit of last stage 108 to anode 130. However, a resistor equal in value to the other resistors in the resistor divider string was chosen for simplicity of calculating the voltage applied per stage. The input end of the multiplier was biased to a negative bias $V_{APP}$ 120 of 650 volts, and referenced to ground. Anode 130 was connected to an ammeter (not shown) that measured the output current of the multiplier.

In an evacuated chamber, a 2.7-mm-diameter 50 keV $O^+$ ion beam was first directed into a Faraday cup apparatus to measure the incident $O^+$ beam current $I_{IN}$, and then directed into the input end of the foil electron multiplier. The output current $I_{OUT}$ from the foil electron multiplier was measured as a function of the applied voltage $V_{APP}$. This was performed for foil electron multipliers configurations having 2, 3, and 4 foil stages.

Figure 5:
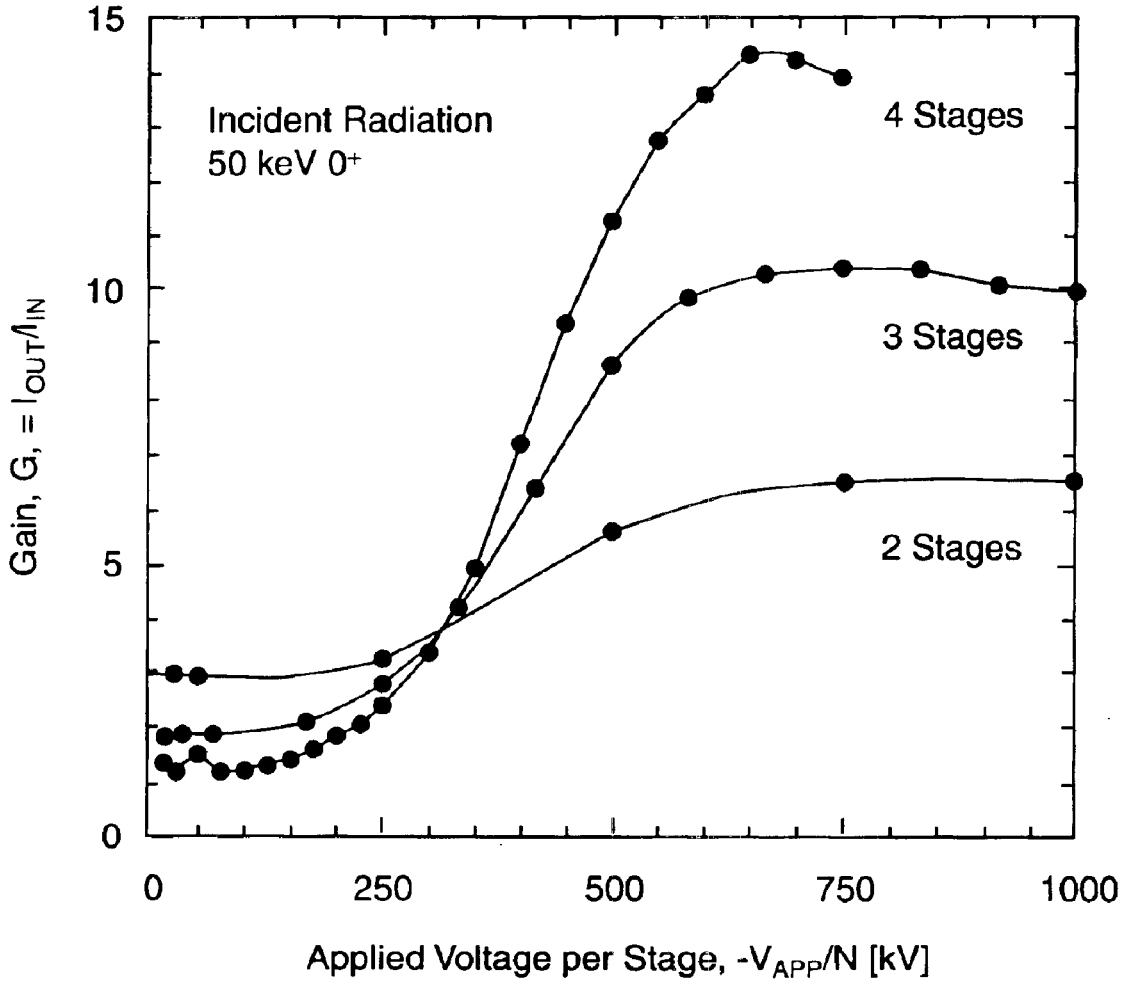
FIG. 5 graphically shows the gain produced with a foil electron multiplier having 2, 3, and 4 foil stages as a function of the applied voltage-per-stage.

The multiplier gain, which is defined as the ratio $I_{OUT}/I_{IN}$, is shown in FIG. 5 as a function of the applied voltage $V_{APP}$ for the multiplier configurations. As the applied voltage is increased, the multiplier gain increases to a maximum at an applied voltage of approximately 650 V per stage. This voltage corresponds to an energy sufficient for secondary electrons to transit a foil and exit with an energy at which they can efficiently generate secondary electrons at the exit surface. At $V_{APP}$=0 V, only electrons generated at the exit surface of the last foil from incident $O^+$ that transits the last foil are measured, and the decrease in the gain for an increasing number of stages results from attenuation of the incident $O^+$ beam by the structural support grid in each stage.

Figure 6:
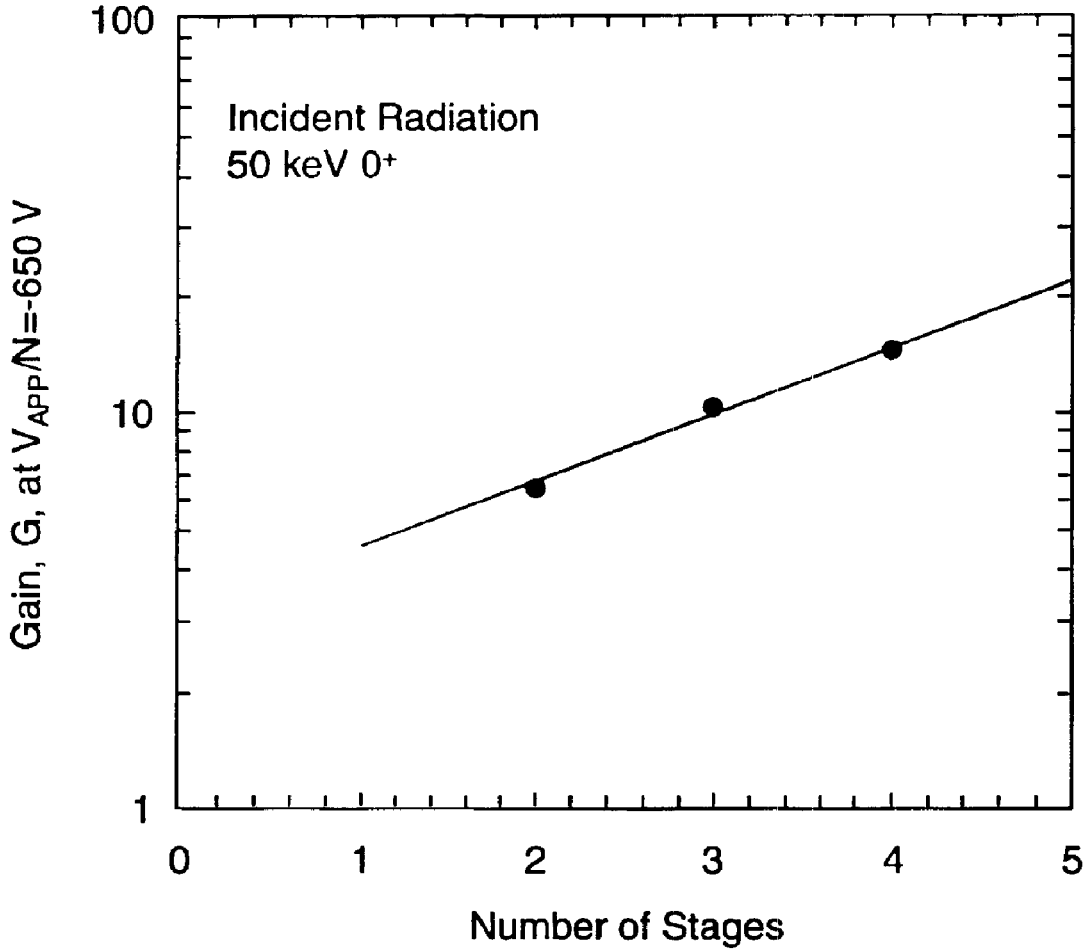
FIG. 6 graphically shows the gain of a foil electron multiplier at an applied voltage-per-stage in the range of −650 V to −750 V.

FIG. 6 shows the maximum gain, that occurs at a voltage per stage of $V_S=V_{APP}/N\approx-650$ V as a function of the number N of stages. On a semi-log plot, the data generally follow a straight line that infers a gain behavior described by Equations 1 through 4. The data was fit to Equation 4 using, for simplicity, the largest two terms n=N−1 and n=N−2 in the fitted equation. For $T_G$=0.78, the fit resulted in $T_{FI}$=3.83 and $T_{SE}(\gamma_{SE}+1)$=1.88, which is shown as the solid line in FIG. 5. The fit agreed well with the data, and the gain per stage $T_{SE}(\gamma_{SE}+1)$=1.88 is higher than the equivalent gain-per-stage equal to ~1.37 of a microchannel plate detector. This higher gain per stage results in fewer required stages in a foil electron multiplier than a conventional electron multiplier.

These results demonstrate that the foil electron multiplier performs as described in Equations 1–4 and that a foil electron multiplier has a higher gain efficiency than conventional electron multipliers.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An apparatus for electron multiplication by transmission, comprising:

(a) at least one foil having a front side for receiving incident particles at a first energy level and a back side for transmitting secondary electrons produced from said incident particles transiting said foil from said front side to said back side, (b) said foil having a thickness effective for said incident particles arriving at said first energy level to transit from said front side to said back side with sufficient energy to produce secondary electrons in transit from said backside, (c) an anode arranged to collect negatively charged incident particles and said secondary electrons from said back side of said foil, (d) an evacuated enclosure containing and supporting said foil and said anode, and (e) an electrical power supply connected to said at least one foil and said anode to provide an electrical field gradient effective to accelerate said secondary electrons from said back side toward said anode.

2. The apparatus of claim 1 where said at least one foil is connected to said evacuated enclosure by at least one foil holder.

3. The apparatus of claim 2 where said at least one foil is a plurality of foils and where said at least one foil holder is a plurality of foil holders.

4. The apparatus of claim 3 where said electrical power supply is connected to each one of said plurality of foils to provide an electrical potential therebetween effective to accelerate said secondary electrons from a back side of one foil to a front side of an adjacent foil with sufficient energy to transit said adjacent foil and produce additional secondary electrons at said back side of said adjacent foil.

5. The apparatus of claim 3 where said electrical power supply is a plurality of electrical power supplies where one power supply is connected to each foil to provide an electrical potential between each foil effective to accelerate said secondary electrons from a back side of one foil to a front side of an adjacent foil with sufficient energy to transit said adjacent foil and produce additional secondary electrons at said back side of said adjacent foil.

6. The apparatus of claim 1 where said at least one foil material is selected from the group consisting of electrical conductors, semiconductors, and dielectrics with finite electrical resistivity.

7. The apparatus of claim 1 where said at least one foil material is selected from the group consisting of carbon, metal, and metal alloys.

8. The apparatus of claim 1 where said at least one foil material is a hydrocarbon.

9. The apparatus of claim 3 where said at least one foil holder material is an electrical conductor.

10. The apparatus of claim 3 where said at least one foil holder material is selected from the group consisting of metal, metal alloys, semiconductors, and insulators with a finite resistance.

11. The apparatus of claim 2 where said at least one foil holder is connected to a grid that supports said at least one foil.

12. The apparatus of claim 11 where said grid material is an electrical conductor.

13. The apparatus of claim 11 where said grid material is selected from the group consisting of metal, metal alloys, semiconductors, and insulators with a finite resistance.

14. The apparatus of claim 1 where said anode comprises a conductive material.

15. The apparatus of claim 1 where said anode comprises a scintillator material that converts electrons to light.

16. The apparatus of claim 1 where said anode comprises a phosphor scintillator material.

17. The apparatus of claim 3 where said plurality of foil holders align said plurality of foils collinearly.

18. The apparatus of claim 3 where said plurality of foil holders align said plurality of foils in an arc.

19. The apparatus of claim 1 where said at least one foil has an areal thickness from about 0.2 $\mu g/cm^2$ to about 2 $\mu g/cm^2$.

20. The apparatus of claim 1 where said at least one foil has an areal thickness of 0.2 $\mu g/cm^2$ to 1 $\mu g/cm^2$.

* * * * *